US005102296A

United States Patent [19]

Kimberlin

[11] Patent Number: 5,102,296

[45] Date of Patent: Apr. 7, 1992

[54] TURBINE NOZZLE, AND A METHOD OF VARYING THE POWER OF SAME

[75] Inventor: Robert R. Kimberlin, Athens, Pa.

[73] Assignee: Ingersoll-Rand Company, Woodcliff Lake, N.J.

[21] Appl. No.: 403,818

[22] Filed: Sep. 7, 1989

[51] Int. Cl.[5] ..... F01D 9/00; F01D 17/00

[52] U.S. Cl. ..... 415/186; 415/202; 415/208.3; 415/209.1; 415/211.1

[58] Field of Search ..... 415/182.1, 183, 185, 415/186, 202, 203, 208.1, 208.3, 208.2, 209.1, 211.1, 211.2; 29/889.2, 889.21, 889.22

[56] References Cited

U.S. PATENT DOCUMENTS

| | | | |
|---|---|---|---|
| 768,116 | 8/1904 | Dutton | 415/202 |
| 980,503 | 1/1911 | Edgar | 415/202 |
| 1,641,665 | 9/1927 | Devaud | 415/119 |
| 2,331,076 | 10/1943 | Neldaal | 415/208.2 |
| 3,909,157 | 9/1975 | Wathtell et al. | 415/186 |
| 4,780,057 | 10/1988 | Silvestri, Jr. | 415/202 |
| 4,856,163 | 8/1989 | Horiuchi et al. | 29/157 C |

*Primary Examiner*—Edward K. Look
*Assistant Examiner*—Hoang Nguyen
*Attorney, Agent, or Firm*—Robert F. Palermo; Bernard J. Murphy; Walter C. Vliet

[57] ABSTRACT

The nozzle has a full complement of blades, for use, for example, in a compressed-air turbine. However, a pair of peripheral walls, at opposite sides of the nozzle platform, block nozzle blade groups. The walls prevent fluid flow through those blade groups and, consequently, the nozzle has limited power. The method teaches the machining away of as much of the walls as is necessary to enhance the power of the nozzle by exposing more of the nozzle blades to free fluid flow therethrough. By providing such walled, fully bladed nozzles, and removing portions of the walls, one can meet any power requirement, from full power to any practical minimum by removing the walls entirety, or removing only a minor portion of each, respectively.

6 Claims, 2 Drawing Sheets 40
34
18
18
18
22
14
16
12
38
26
10
32
30
20
24
28

TURBINE NOZZLE, AND A METHOD OF VARYING THE POWER OF SAME

BACKGROUND OF THE INVENTION

This invention pertains to fluid turbines, and in particular to (a) turbine nozzles, and (b) methods of varying the power of such nozzles.

Fluid turbines, for example, compressed air turbines, are designed to meet varying power requirements. A way of satisfying differing power requirements is to configure the nozzles thereof with differing numbers of blades. That is, for given circumstances, a nozzle can be formed with X number of blades for maximum power, X/2 for half power, and X/4 for one-quarter power.

What has been long sought is a nozzle which is capable of meeting all possible power requirements. By this, the necessity to manufacture and stock a supply of variously bladed nozzles is ended.

It is an object of this invention to set forth the long sought, universal-power nozzle. Concomitantly, it is also an object of this invention to teach a method of varying the power of a turbine nozzle.

SUMMARY OF THE INVENTION

Particularly it is an object of this invention to disclose a turbine nozzle comprising a platform defining a substantially circular shape plurality of blades having leading and trailing edges arrayed on said platform adjacent to said periphery and defining a plurality of nozzle passages; and means formed about the periphery of said platform, integral with the leading edges of sequential ones of said blades, for preventing a flow of fluid through said nozzle passages.

Another object of this invention is to set forth a method of increasing the power of a turbine nozzle, comprising the steps of providing a turbine nozzle which includes a platform having a periphery defining a substantially circular shape a plurality of equally spaced blades having leading and trailing edges arrayed on the periphery of said platform, and defining a plurality of nozzle passages adjacent to said periphery, and a periphery wall integral with said leading edges of said blades, for preventing a flow of fluid through said nozzle passages; and removing portions of said wall to permit fluid flow through sequential ones of said nozzle passages.

Further objects of this invention, as well as the novel features and method steps thereof will become more apparent by reference to the following description, taken in conjunction with the accompanying figures, in which:

DETAILED DESCRIPTION

Figure 1:
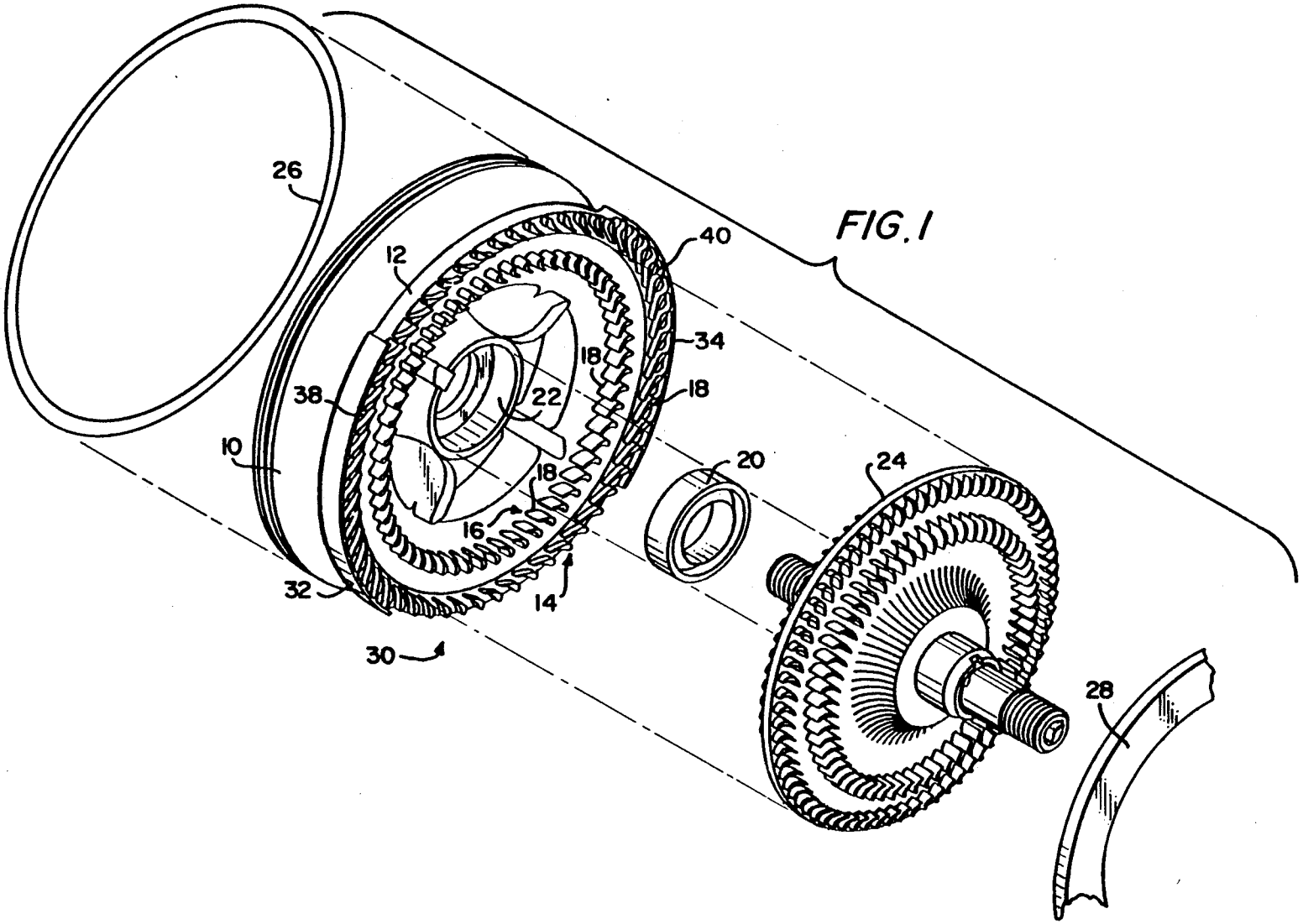
FIG. 1 is a perspective, exploded view of a portion of a compressed air turbine, the same embodying the invention.

As shown in FIG. 1, an end plate 10, for a compressed air turbine, comprises a platform 12 which has two multiplicities 14 and 16 of blades thereon. The blades 18 extend from the platform 12 in a normal attitude thereto. A rotor shaft seal 20 is received in the central recess 22 in the platform 12, and a bladed rotor 24 is set into the seal. An O-ring seal 26 sets against the end plate 10, and a spacer 28, for a complementary end plate (not shown), only a fragment thereof being shown, is interposed between end plate 10 and the complementary end plate.

Figure 2:
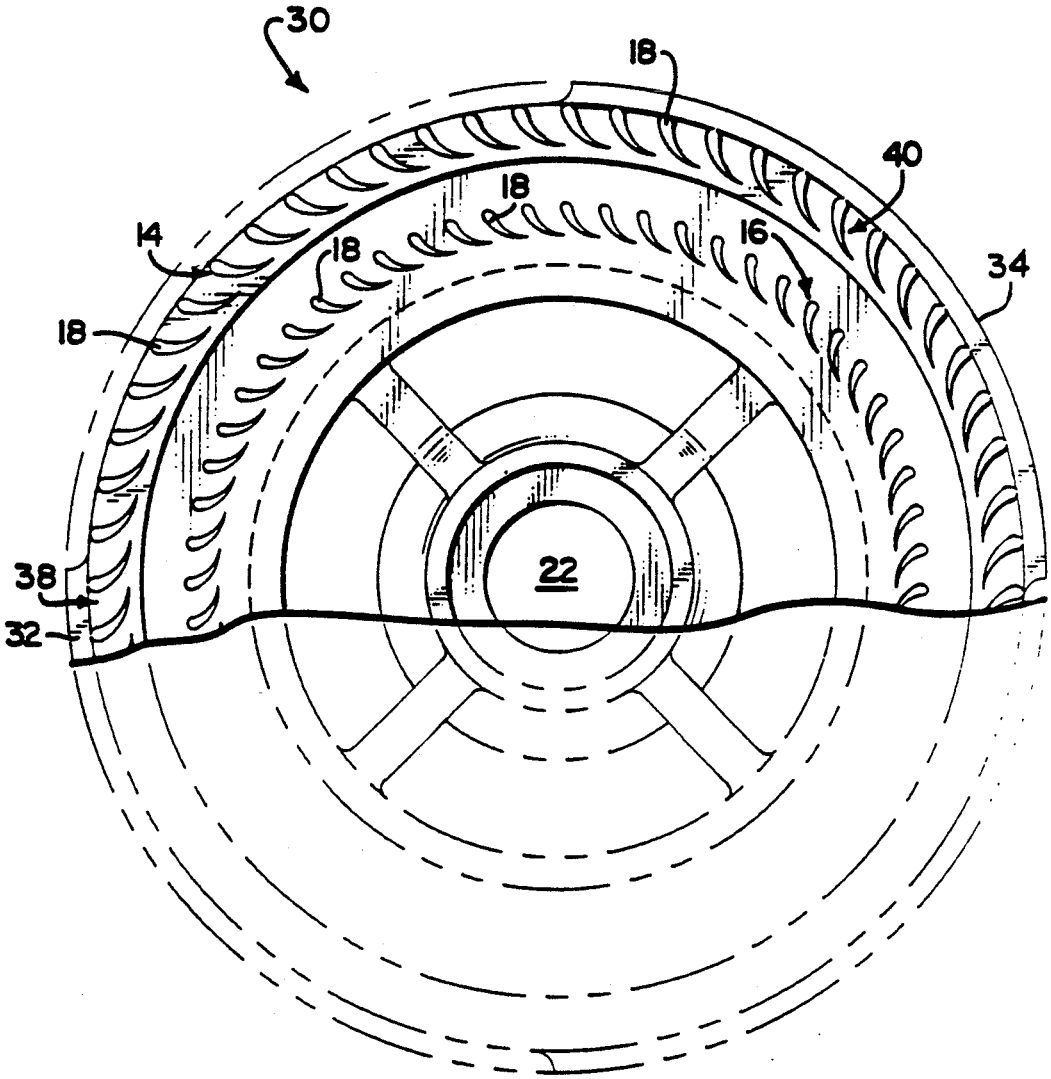
FIG. 2 is a vertical illustration of the nozzle of FIG. 1.

The platform 12, as can be seen in FIGS. 1 and 2, has a full complement of blades 18. Accordingly, the blades and platform, comprising a nozzle 30, is bladed for full power. However, a pair of walls 32 and 34 are coupled to the periphery of nozzle 30, in proximate adjacency to pluralities 38 and 40 of blades. The walls 32 and 34, describing arcs of equal length, inhibit a fluid flow through the blade pluralities 38 and 40. The arc lengths of walls 32 and 34 are formed by machining away portions of the as cast wall which completely circumscribes the platform 12.

As shown, the walls 32 and 34, having heights from the platform 12 substantially the same as the heights of the blades 18 (as can be perceived in FIG. 1), are each of approximately ninety degrees of arc. The nozzle 30, then, is capable of only about half its full power potential.

According to the novel method of the invention, machining away the walls in their entirety will provide nozzle 30 capable of full power. Alternatively, by machining away half—complementary halves—of each of the walls 32 and 34 will render the nozzle capable of approximately three-quarters of its full power potential.

According to this teaching, then, it is no longer necessary to design and construct nozzles with diverse bladings. Fully complemented-bladed nozzles can be formed with walls, like walls 32 and 34, which circumscribe half, three-quarters, one-quarter, etc., as one chooses, of the blades 18. Then, by the simple expedient of machining away so much of the walls as will power the nozzle to the level required, a large number of power levels can be provided.

While I have described my invention in connection with a specific embodiment thereof, it is to be clearly understood that this is done only by way of example, and not as a limitation to the scope of my invention, as set forth in the objects thereof and in the appended claims.

I claim:

1. A turbine nozzle comprising:

a platform having a periphery defining a substantially circular shape;

a plurality of equally spaced blades having leading and trailing edges arrayed on said platform, adjacent to said periphery and defining a plurality of nozzle passages; and a plurality of spaced walls integrally formed about portions of the periphery of said platform, integral with the leading edges of sequential ones of said blades, for preventing a flow of fluid through said nozzle passages.

2. A turbine nozzle, according to claim 1, wherein:

said fluid flow preventing walls circumscribe no less than approximately half of said plurality of equally spaced blades.

3. A turbine nozzle, according to claim 1 wherein:

said plurality of blades extend normal to said platform to a given height; and said plurality of walls also extend normal to said platform to substantially the same height.

4. A method of increasing the power of a turbine nozzle, comprising the steps of:

providing a turbine nozzle which includes a platform having a periphery defining a substantially circular shape, a plurality of equally spaced blades having leading and trailing edges arrayed on the periphery of said platform and defining a plurality of nozzle passages adjacent to said periphery, and a plurality of spaced walls integrally formed on the periphery of the platform and integral with said leading edges of said blades, for preventing a flow of fluid through said nozzle passages; and removing portions of said wall to permit fluid flow through sequential ones of said nozzle passages.

5. A method of increasing the power of a turbine nozzle, according to claim 4, wherein:

said turbine nozzle providing step comprises providing said plurality of walls, as a pair of walls on diametrically opposite sides of said platform.

6. A method of increasing the power of a turbine nozzle, according to claim 4, wherein:

said wall removing step comprises removing portions of said walls, until fluid flow is permitted through the nozzle passages defined by approximately half of said plurality of blades.

* * * * *